US005468216A

United States Patent [19]

Johnson et al.

[11] Patent Number: 5,468,216

[45] Date of Patent: Nov. 21, 1995

[54] KINETIC REHABILITATION DEVICE EMPLOYING CONTROLLED PASSIVE MOTION

[75] Inventors: Gregory E. Johnson, Austin, Tex.; Uriel G. Ashworth, Chase City, Va.; Mark Salerno, Huntington, N.Y.

[73] Assignee: Physicians Consulting Incorporated, Austin, Tex.

[21] Appl. No.: 322,174

[22] Filed: Oct. 12, 1994

[51] Int. Cl.[6] ..... A61H 1/00

[52] U.S. Cl. ..... 601/24; 606/242; 606/245; 5/616; 5/618

[58] Field of Search ..... 601/24, 26, 98, 601/101, 90, 93; 606/242–245; 5/610, 616, 618; 482/142

[56] References Cited

U.S. PATENT DOCUMENTS

| | | | |
|---|---|---|---|
| 2,152,431 | 3/1939 | Jensen | 606/245 |
| 3,051,965 | 9/1962 | Szemplak et al. | 5/616 |
| 4,145,608 | 3/1979 | Shirasaki et al. | 250/231 SE |
| 4,407,030 | 10/1983 | Elliott | 5/618 |
| 4,523,583 | 6/1985 | Noble . | |
| 4,531,730 | 7/1985 | Chenera | 482/142 |
| 4,549,534 | 10/1985 | Zagorski et al. . | |
| 4,602,619 | 7/1986 | Wolf et al. . | |
| 4,760,615 | 8/1988 | Furniss | 5/618 |
| 4,769,584 | 9/1988 | Irigoyen et al. | 5/616 |
| 4,802,462 | 2/1989 | Reiss et al. . | |
| 4,807,601 | 2/1989 | Wright . | |
| 5,031,898 | 7/1991 | Anthony . | |
| 5,044,359 | 9/1991 | Reinert . | |
| 5,094,249 | 3/1992 | Marras et al. . | |
| 5,123,916 | 6/1992 | Riddle et al. . | |
| 5,158,568 | 10/1992 | Riddle et al. . | |
| 5,171,260 | 12/1992 | McIlwain . | |
| 5,258,019 | 11/1993 | Riddle et al. . | |
| 5,282,835 | 2/1994 | Wright et al. | 606/245 |
| 5,297,539 | 3/1994 | Liebl et al. . | |
| 5,320,640 | 6/1994 | Riddle et al. . | |
| 5,320,641 | 6/1994 | Riddle et al. . | |

*Primary Examiner*—Richard J. Apley
*Assistant Examiner*—Jeanne M. Clark
*Attorney, Agent, or Firm*—Haynes and Boone; Jeffrey M. Becker

[57] ABSTRACT

A kinetic rehabilitation device employing controlled passive motion for use in the rehabilitation of the lumbar spine. The device includes a frame, a body support secured to the frame, a control panel, a first and second member secured to the support and pivotally attached to diametrically opposed sides of the frame, and a screw drive assembly for pivoting the first and second members about said frame. A first optical sensor assembly is mounted on one of the pivoting members to zero the body support about its longitudinal axis. A second optical assembly is mounted on the screw drive assembly to feed positional information to the control panel.

11 Claims, 4 Drawing Sheets

KINETIC REHABILITATION DEVICE EMPLOYING CONTROLLED PASSIVE MOTION

TECHNICAL FIELD

This invention relates generally to the field of spinal therapy and rehabilitation, and specifically, to a kinetic rehabilitation device employing controlled passive motion used in treatment and rehabilitation of the lumbar region of the spine to regain motion, strength, and function and to shorten healing duration.

BACKGROUND OF THE INVENTION

In the field of spinal therapy, it is well known that serious loss of motion, painful contractures, and stiffness may occur after back surgery or injury. It is also known that during the rehabilitation period disorganized scars may form in lieu of normal collagen formation which may impede the healing process and subsequent recovery. Many of these complications may be eliminated by passively assisting spinal motion by means of a Kinetic Rehabilitation Device ("KRD") employing controlled passive motion. These devices require a patient to lay in either a prone or supine position, or side position, on a table which provides the necessary flexion and extension to properly passively exercise muscle groups surrounding the lumbar spine.

Several current KRDs provide a means for passively exercising muscle groups surrounding the lumbar spine for postoperative and other rehabilitative therapy. However, because the drive means of such devices are often comprised of a chain-driven drive system that uses cams and push-rods to effect movement of the patient, the devices lack the necessary precise control and consistency needed to prescribe specific rehabilitative therapy. More specifically, the amount of flexion and extension is unduly limited by the cam openings that dictate the range of motion of the chain-driven systems. Furthermore, changing the degree of flexion and extension can be dangerous and time consuming because the user must physically move the push-rod from one opening in the cam to another.

Additionally, most KRDs do not have diagnostic capabilities whereby a practitioner can increase the flexion or extension of a patient in small increments until the patient provides the appropriate feedback. For example, in a chain-driven KRD the cam and push-rod assembly requires that the device go through its full range of motion before returning to the starting position. However, some KRDs allow a patient who senses discomfort to immediately arrest the movement of the pivoting table by means of a control button or some other device. Although such pivoting tables will stop, they do so in theft current position leaving the patient extended or flexed over the table unable to exit the table and relieve the discomfort.

Moreover, while using some KRDs a patient will suffer discomfort due to the shear force applied against her face created by the movement of a pad against the patient's static face. Some KRDs provide an opening in the pad positioned against the patient's face to reduce the shear force, but the force is not completely removed because the sides of the patient's face are positioned against the inside of the moving opening.

Unfortunately, the aforementioned problems culminate in the patient being required to participate in supervised care for a longer time period, ultimately inhibiting the patient's recovery.

SUMMARY OF THE INVENTION

It is therefore an object of the present invention to provide a Kinetic Rehabilitation Device ("KRD") that provides the necessary precise control and consistency needed to prescribe effective rehabilitative therapy.

It is a further object of the present invention to provide a KRD of the above type that can be adjusted safely and easily within precise ranges of motion to allow for accurate and consistent therapeutic routines.

It is a further object of the present invention to provide a KRD of the above type that allows for independent settings for flexion, extension, speed, and duration.

It is a further object of the present invention to provide a KRD of the above type whose flexion and extension is adjustable in 1 degree increments.

It is a further object of the present invention to provide a KRD of the above type that provides flexion and extension of up to 50 degrees.

It is a further object of the present invention to provide a KRD of the above type which returns automatically to its horizontal starting position when the KRD is activated and when the therapy routine is interrupted.

It is a still further object of the present invention to provide a KRD of the above type in which facial shearing is reduced during therapy sessions.

Toward the fulfillment of these and other objects, the KRD of the present invention includes a screw-drive assembly, optical sensors, and an on-board control panel.

The KRDs screw-drive assembly elevates and lowers the body support in a synchronous manner, providing flexion and extension to a maximum of 50 degrees from the horizontal plane, as regulated by a micro-processor controller unit. The screw-drive assembly is comprised of a worm gear drive, a roll thread, and a ball nut that enables the KRD to be adjusted in 1 degree increments, thereby allowing the practitioner to examine the patient and prescribe a therapy routine consistent with the diagnosis and with greater precision than current KRDs allow.

An optical sensor is provided in the form of a photo-emitter/photo-detector pair to detect when the body support is in a substantially horizontal position. A second optical sensor is provided in the form of a photo-emitter/photo-detector pair to detect the angular position and velocity of the body supports and feed such information back to the micro-processor controller unit.

Finally, the KRD is also equipped with a glidable face pad which is mounted flush in the torso support pad portion of the KRD's body support. The face pad moves against the motion of the torso support pad portion of the body support eliminating facial skin shear and ensuring that the patient will be properly positioned during therapy sessions.

BRIEF DESCRIPTION OF THE DRAWINGS

The above brief description, as well as further objects, features, and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENTS

Figures 1, 3, 4:
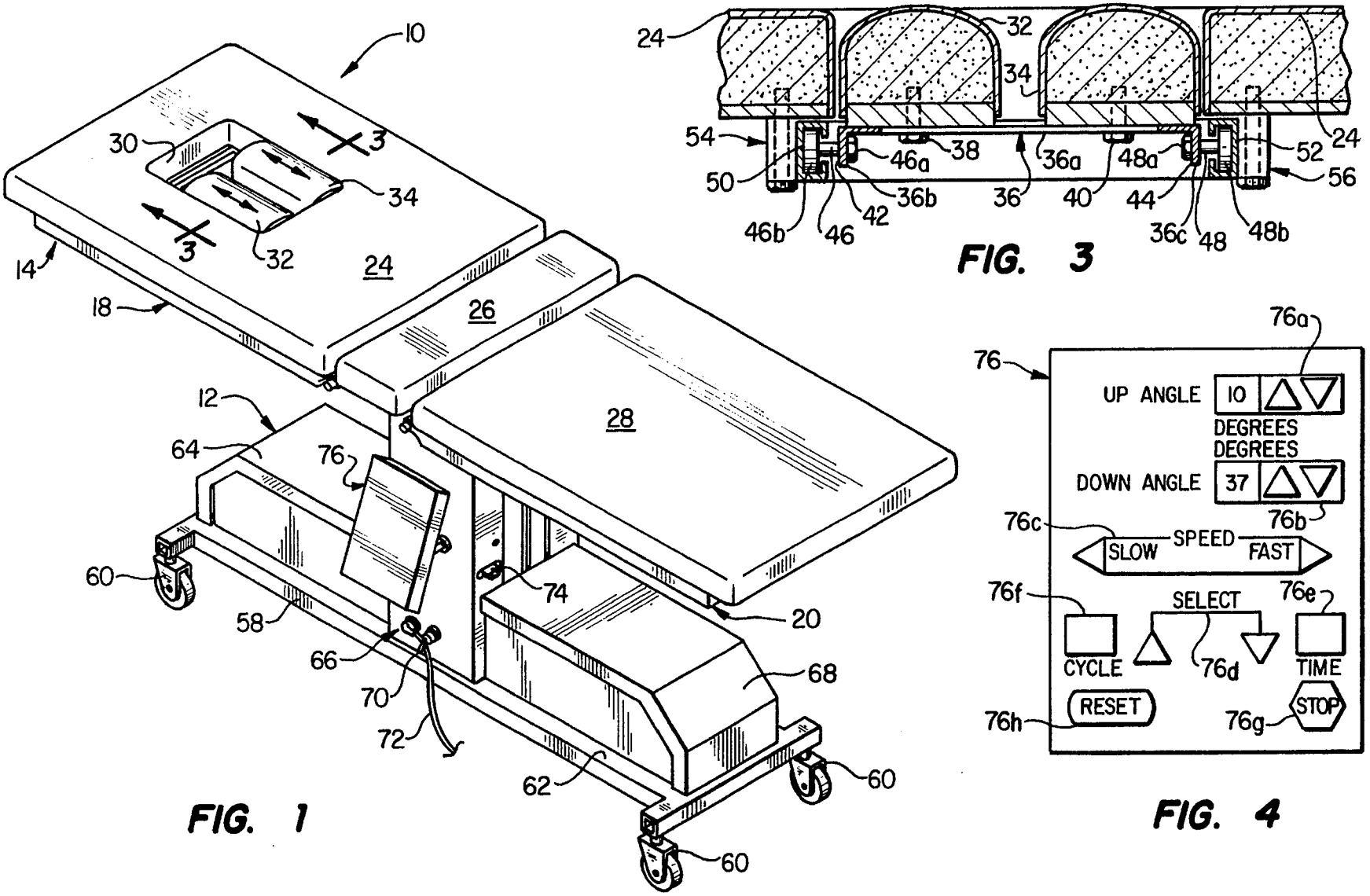
FIG. 1 shows a perspective view of the Kinetic Rehabilitation Device ("KRD") of the present invention.
FIG. 3 shows an enlarged, partial sectional view taken along the line 3—3 of FIG. 1.
FIG. 4 shows an enlarged front view of the control panel of the present invention.

In FIG. 1, the reference numeral 10 refers in general to the Kinetic Rehabilitation Device ("KRD") of the present invention. The KRD 10 includes a frame 12 that supports a body support 14. Both the frame 12 and the body support 14 are constructed of a sturdy material such as steel or the like to support the weight of a patient.

Figure 2:
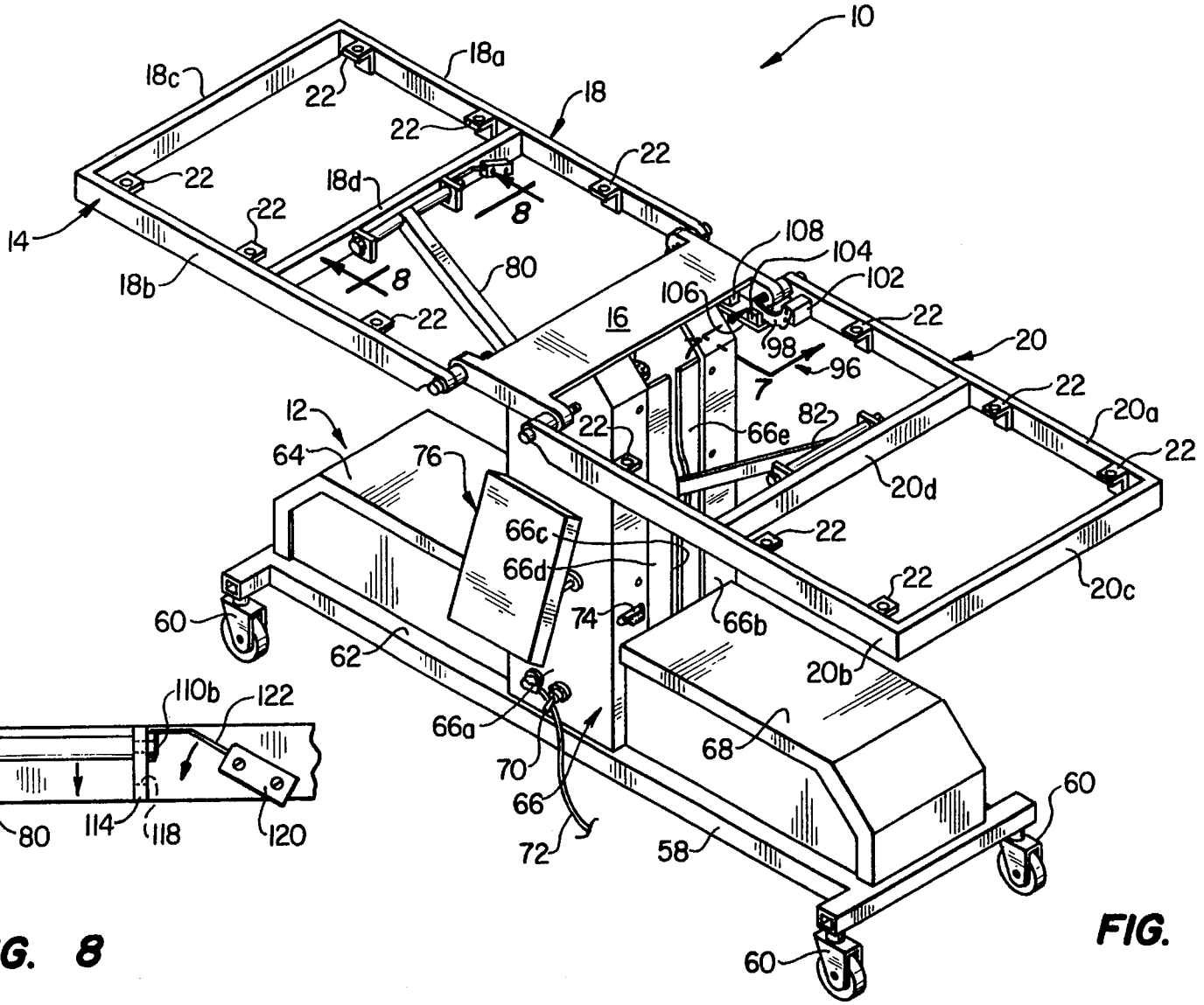
FIG. 2 shows the KRD of FIG. 1 with the torso, center, and leg support pads removed.

Turning first to the construction of the body support 14 and referring to both FIGS. 1 and 2, the body support 14 is comprised of a central stationary support 16 for supporting the center region of a patient and two outwardly extending, diametrically opposed, horizontal supports 18 and 20 for supporting the torso and legs of a patient, respectively. The torso support 18 is comprised of two spaced parallel members 18*a* and 18*b* that are pivotally connected to the support 16 at their proximal ends, and a member 18*c* rigidly extending between corresponding distal ends of the members 18*a* and 18*b*. A member 18*d* rigidly extends between the members 18*a* and 18*b* approximately midway between and parallel to the member 18*c* and the support 16.

The leg support 20 is essentially identical to the torso support 18 and is comprised of two spaced parallel members 20*a* and 20*b* that are pivotally connected to the support 16. A member 20*c* is rigidly attached to and extends between corresponding distal ends of members 20*a* and 20*b*, and a member 20*d* rigidly extends between the members 20*a* and 20*b* approximately midway between and parallel to the member 20*c* and the support 16. A plurality of mounting brackets 22 are spaced from each other and rigidly attached to members 18*a*, 18*b*, 20*a*, and 20*b* for reasons that will be discussed.

As shown in FIG. 1, a torso support pad 24 is rigidly attached in a conventional manner to the torso support 18 via the plurality of mounting brackets 22 that are positioned about the members 18*a* and 18*b*. A center support pad 26 is secured to the support 16 in a conventional manner, and a leg support pad 28 is rigidly attached in a conventional manner to the leg support 20 via the plurality of mounting brackets 22 that are positioned about the members 20*a* and 20*b*. The torso support pad 24, the center support pad 26, and the leg support pad 28 collectively form a table on which a patient is positioned during therapy sessions.

The torso support pad 24 has an opening 30 in which a pair of face pads 32 and 34 are slidably retained by a sliding channel assembly 36 as shown in FIG. 3. Referring to FIG. 3, the sliding assembly 36 is comprised of a plate 36*a* having a pair of downwardly extending, parallel flanges 36*b* and 36*c*. The face pads 32 and 34 are attached to the upper surface of the plate 36*a* by screws 38 and 40 to be flush with the torso support pad 24. The flanges 36*b* and 36*c* have openings 42 and 44, respectively, for rotatably receiving shafts 46 and 48, respectively, that are secured within the openings by nuts 46*a* and 48*a*. A wheel 46*b* is attached to the distal end of the shaft 46 and a wheel 48*b* is attached to the distal end of the shaft 48 for being slidably received within a pair of inwardly facing, spaced, and parallel rails 50 and 52 attached via connectors 54 and 56 to the underside of the torso support pad 24.

Referring again to FIG. 1, the frame 12 is comprised of a central platform 58 supported by a plurality of casters 60, which platform provides an upper support surface 62 on which housings 64, 66, and 68 are conventionally mounted. As discussed below, the housings 64 and 68 shroud motors and electronic and other equipment (FIG. 5) used to operate the KRD 10.

As shown in FIG. 2, the housing 66 has a front panel 66*a* and a rear panel 66*b* spaced to form an opening 66*c* for reasons to be described. The opening 66*c* is partially closed by rubber attachments 66*d* and 66*e* that extend from the front and rear panels 66*a* and 66*b*, respectively, to protect the equipment disposed within the housing 66 discussed below. A power switch 70 and an activation button 72 (not completely illustrated) extend from the front panel 66*a* of housing 66. A serial port 74 is located on the side of the front panel 66*a* of the housing 66 for inputting and down loading data from the KRD 10 to a personal computer (not shown).

A control panel 76 is mounted on the front panel 66*a* of the housing 66 for controlling the movement of the body support 14. As seen in FIG. 4, the control panel 76 has an up angle setting selector 76*a*, a down angle setting selector 76*b*, a speed adjustor 76*c*, a time selector 76*d*, a time display window 76*e*, a cycle display window 76*f*, a stop button 76*g*, and a reset button 76*h*.

Figure 5:
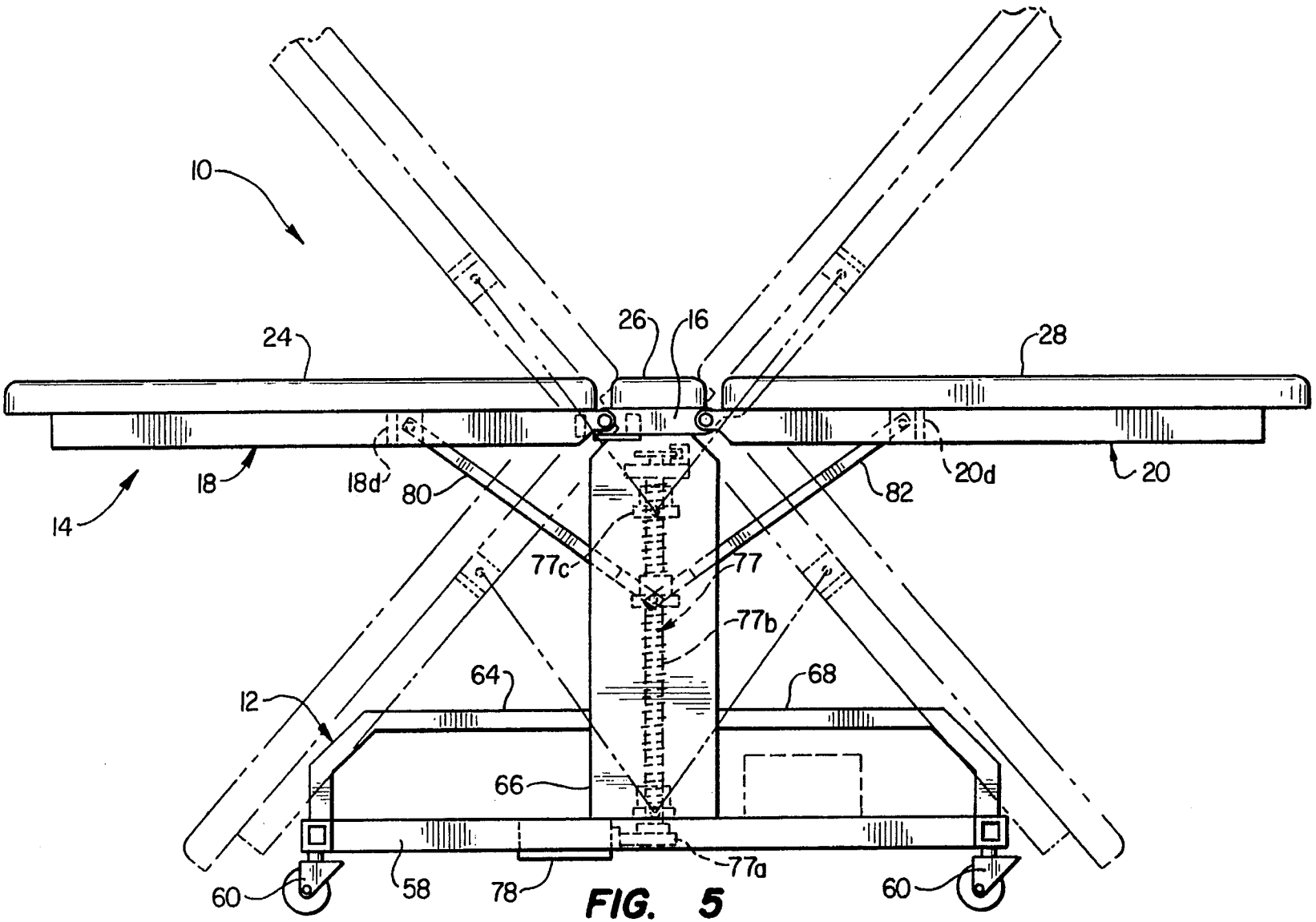
FIG. 5 shows a rear view, partially in section, depicting the extreme angular ranges of the KRD of FIG. 1.

Referring now to FIG. 5, a screw drive assembly 77 is disposed within the housing 66 for driving the body support 14. The screw drive assembly 77 is comprised of a worm gear 77*a* operationally attached to a reversible and variable speed motor 78 contained within the housing 64, a roll thread 77*b* drivingly attached at its lower end to the worm gem 77*a* and a ball nut 77*c* rotatably received by the roll thread 77*b*. Although not shown, the ball nut 77*c* has a plurality of ball-bearings disposed between its inner shell and the roll thread 77*b* to assist the ball nut 77*c* in ascending and descending the roll thread 77*b*.

Figure 6:
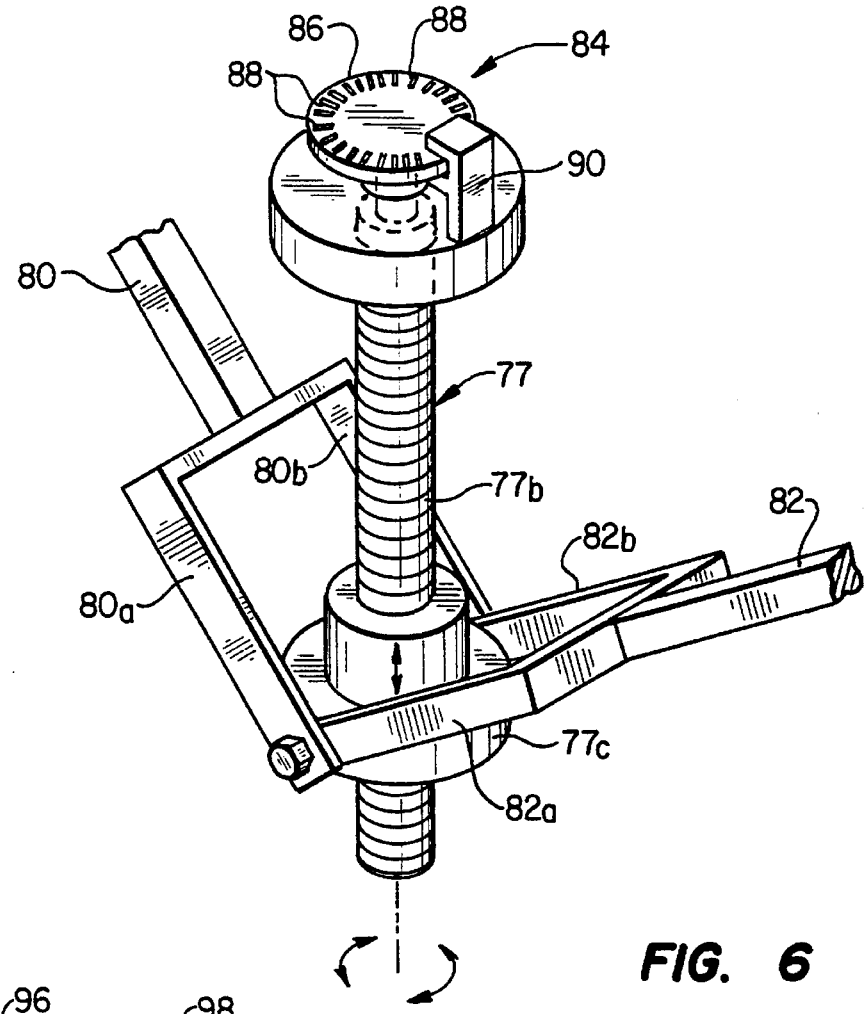
FIG. 6 shows an enlarged elevational view of the screw-drive assembly of the present invention.

As better shown in FIG. 6, a pair of arms 80 and 82 having fingers 80*a* and 80*b*, and 82*a* and 82*b*, respectively, are pivotally connected to and extend outwardly from opposite sides of the ball nut 77*c* for joining the screw drive assembly 77 to the torso and leg supports 18 and 20, as is further described below. Still referring to FIG. 6, an optical sensor assembly 84 for relaying positional information to the control panel 76 is attached to the upper end of the roll thread 77*b* and is comprised of a disk 86 having a plurality of radially extending slots 88 that rotate with the roll thread 77*b*. A photo-emitter/photo-detector pair 90 is mounted on opposite sides of the disk 88 to sense the amount of movement of the roll thread 77*b*.

Figure 7A:
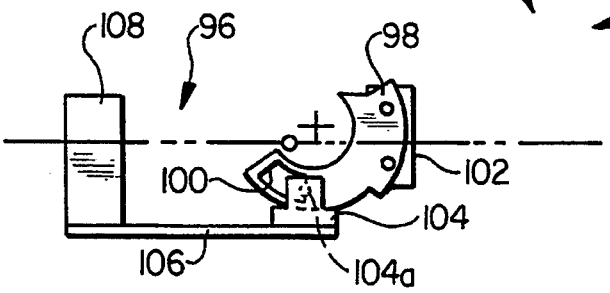
FIGS. 7A, 7B, and 7C show enlarged., partial sectional views taken along the line 7—7 of FIG. 2.
Figure 7C:
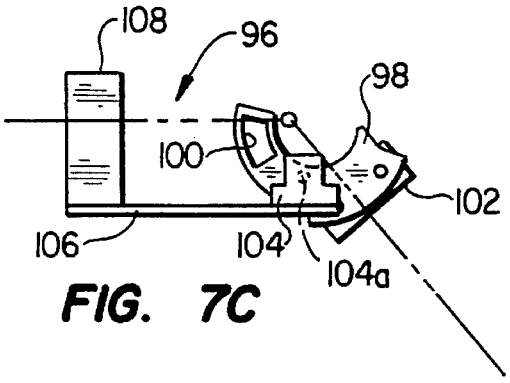
Figure 7B:
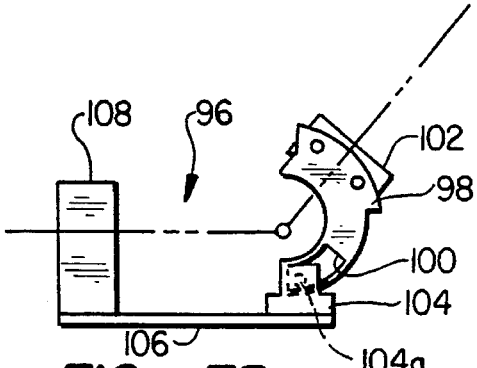

Referring now to FIGS. 7A–7C, an optical sensor assembly 96 mounted below the body support 14 (FIG. 2) is provided for detecting when the torso and leg supports 18 and 20 are horizontally positioned and includes an arcuate curved member 98 having a slot 100 cut therethrough. The member 98 is rigidly connected to the member 20*a* via mounting bracket 102, as seen in FIG. 2. A photo-emitter/photo-detector pair 104 is rigidly mounted to the central stationary support 16 via a printed circuit board 106 mounted to a bracket 108 for receiving the curved member 98 therebetween. The curved member 98 is disposed between the photo-emitter/photo-detector pair 104 such that a light beam 104*a* passing between the pair will alternately pass through the slot 100 or be blocked by the curved member 98 during movement of the member 20*a*. More particularly and as seen in FIG. 7A, the light beam 104*a* hits the edge of the slot 100 when the member 20*a* is horizontally positioned. FIG. 7B illustrates the position of the arcuate member 98 when the member 20*a* is angled above horizontal, while FIG. 7C illustrates the position of the arcuate member 98 when the member 20*a* is angled below horizontal.

Figure 8:
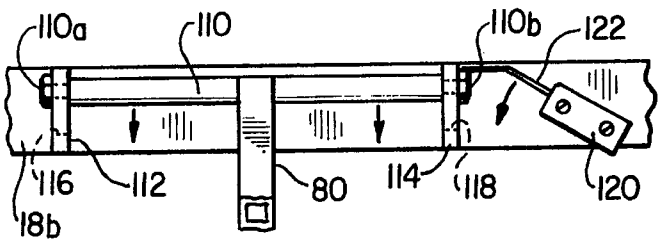
FIG. 8 shows an enlarged, partial section view taken along the line 8—8 of FIG. 2.

Referring to FIGS. 2 and 8, the arm 80 extends outwardly from the opening 66*c*, terminating with a substantially horizontally extending rod 110. The ends of the rod 110 extend through slots 116 and 118 contained in a pair of spaced parallel brackets 112 and 114 rigidly connected to the member 18*d*, respectively, and are pivotally secured therein by end caps 110*a* and 110*b*. The slots 116 and 118 are extended to allow the rod 110 to move relative to the member 18*d* and thus the torso support 18 for reasons described below. A micro-switch 120 having a sensor member 122 is rigidly attached to member 18*d*, the sensor member 122 being biased against the end cap 110*b* of the rod 110 for reasons that will be described. Although not shown, the arm 82 extending outwardly from the housing 66*c* is attached to the member 20*d* in the same manner as arm 80 is attached to member 18*d* (FIG. 2). Member 20*d* also has a micro-switch sensor biased against the connecting rod as depicted in FIG. 8 for arm 80.

In operation, a patient lies on the support pads 24, 26, and 28, turns on the power switch 70, and controls the operation of the KRD 10 via the activation button 72 and the control panel 76. The control panel 76 enables an operator or the patient to program a sequence of rehabilitative therapy routines to be conducted with independent settings for flexion, extension, speed, and duration. Flexion and extension are adjustable in single degree increments and can be independently set via the up angle setting selector 76*a* and the down angle setting selector 76*b*, respectively, up to 50 degrees of motion in each direction. Speed is adjustable incrementally and duration in minute increments via the speed adjustor 76*c* and the time selector 76*d*, respectively.

Once a therapy routine has been entered, the control panel's micro-processor activates the motor 78 which in turn drives the worm gear 77*a* causing the roll thread 77*b* to rotate about its vertical axis. The ball nut 77*c* ascends or descends the roll thread 77*b* in accordance with the direction and the velocity in which the worm gear 77*a* drives the roll thread 77*b*. A clockwise rotation about the roll thread's vertical axis causes the ball nut 77*c* to ascend, while a counterclockwise rotation causes it to descend. Pivotally connected to the ball nut 77*c* are arms 80 and 82 for driving each pivoting support member 18 and 20 in a synchronous manner, providing both flexion and extension of up to 50 degrees from horizontal in 1 degree increments. Furthermore, as the torso support member 18 flexes or extends, the gliding face pads 32 and 34 move relative to the torso support member 18 to maintain the patient's prone position and to reduce facial shear.

The movement of the ball nut 77*c* is precisely controlled by the photo-emitter/photo-detector pair 90 in the following manner. As the roll thread 77*b* rotates, so does the disk 86 and its plurality of radially extending slots 88. The photo-emitter portion of the photo-emitter/photo-detector pair 90 emits a light beam (not shown) that is directed perpendicular to the disk 86. As the disk 86 rotates, one of the slots 88 of the disk 86 aligns to allow the light beam to pass through towards the photo-detector portion of the photo-emitter/photo-detector pair 90. As the photo-emitter/photo-detector pair 90 sends and receives the light beam, it produces a electrical signal that transmits the appropriate positional information to the control panel 76.

At the beginning of each therapy session or routine, the body support 14 will zero itself about its longitudinal axis to rest in a horizontal position. The body support's zero position is sensed by the optical sensor assembly 96, which is provided for determining when the pivoting supports 18 and 20 are in a horizontal position as described above. The body support 14 will also zero itself to a horizontal position when either of the supports 18 or 20 encounters an object that prohibits its downward movement as described below, when the activation button 72 is activated, and when the KRD is initially powered up.

The micro-switch 120 disposed underneath the body support 14 protects against resistance caused by an obstruction inhibiting the downward movement of the KRD 10. If the micro-switch 120 is triggered, the KRD 10 will immediately return to a horizontal position at the slowest possible speed, in the following manner. Upon engaging an obstruction, the support 18 will stop, causing the rod 110 extending from the arm 80 to slide to the lower portion of the slots 116 and 118 as the ball nut 77*c* continues its descent. The relative movement between the rod 110 and the support 18 activates the sensor member 122, thereby triggering the micro-switch 120 to immediately cease the downward movement of the ball nut 77*c*. However, instead of stopping and remaining in its current downwardly angled position, the supports 18 and 20 will move upwardly at the slowest possible speed until the supports 18 and 20 are back at horizontal, as determined by the optical sensor assembly 96. It is understood that a micro-switch (not shown) connected to the support 20 operates in a similar manner.

It is thus seen that the KRD 10 of the present invention provides several advantages. For example, the screw drive assembly 77, the optical sensor assembly 84 and the control panel 76 combine to provide a KRD that can be adjusted safely and easily within precise ranges of motion to allow for accurate and consistent therapeutic routines. As opposed to prior art devices that require the user to physically adjust push-rods from one cam opening to another to adjust the routine, the KRD 10 is adjusted by simplifying resetting the controls on the control panel 76. Moreover, the control panel 76 can be used not only to adjust the amount of flexion and extension, it also provides speed and duration control, from an on-board controller. In addition, as the KRD 10 allows for flexion and extension adjustments in 1 degree increments up to 50 degrees in each direction, the present invention provides the necessary range of movement and precise control and consistency needed to prescribe specific rehabilitative therapy and perform diagnostic tests with patient feedback.

Also, the optical sensor assembly 96 in combination with the screw drive assembly 77 enables the KRD 10 to always start a routine from a horizontal position and to return to its horizontal position smoothly and safely with little or no discomfort to the patient upon the conclusion or interruption of the routine, thereby enabling the patient to more easily mount and exit the device. Further, the micro-switch 120 of the present invention provides a means for the KRD 10 to return automatically to its horizontal position when the body support 14 encounters any object that inhibits its downward movement. Further still, the facial pads 32 and 34 assist the patient in maintaining the prone position comfortably, while reducing facial shearing often suffered during therapy sessions.

It is understood that variations may be made in the foregoing without departing from the scope of the invention. For example, the two facial pads 32 and 34 may be combined into one pad. Also, the optical sensor assembly 96 may be placed on any member that pivots during the therapy session. The only requirement of such placement is that the optical sensor assembly 96 be calibrated or zeroed about a substantially horizontal axis prior to the operation of the KRD.

Other changes and substitutions are intended in the foregoing disclosure and in some instances some features of the invention will be employed without a corresponding use of the other features. Accordingly, it is appropriate that the appended claims be construed broadly and in a manner consistent with the scope of the invention.

What is claimed is:

1. A kinetic rehabilitation device, comprising:

a base;

a body support, comprising:

a central stationary support rigidly connected to said base; and first and second supports pivotally connected to and extending outwardly from diametrically opposed ends of said stationary support;

a vertical guide housed within said base;

a connector mounted on said guide for vertical movement;

a first arm extending between and pivotally connected to said connector and said first support and a second arm extending between and pivotally connected to said connector and said second support for driving said first and second supports pivotally about said stationary support; and means for driving said connector.

2. The kinetic rehabilitation device of claim 1 wherein said guide is a roll thread and said connector is a ball nut rotatably mounted on said guide.

3. The kinetic rehabilitation device of claim 2 wherein said driving means comprises a reversible motor operatively connected to said guide for rotating said roll thread.

4. The kinetic rehabilitation device of claim 1 further comprising means connected to said body support for sensing when said first and second supports are horizontally positioned.

5. The kinetic rehabilitation device of claim 1 further comprising an optical sensor assembly for sensing when at least one of said first and second supports is horizontally positioned, said assembly comprising:

an arcuate member rigidly connected to at least one of said first or second supports, said member having a hole; and a photo emitter/detector pair rigidly connected to said stationary support for receiving said member therebetween.

6. The kinetic rehabilitation device of claim 1 further comprising means connected to said guide for sensing rotation of said guide.

7. The kinetic rehabilitation device of claim 1 further comprising an optical sensor assembly for sensing rotation of said guide, said assembly comprising a disc connected to said guide having a plurality of radially extending slots and a photo emitter/detector pair for receiving said disc therebetween.

8. The kinetic rehabilitation device of claim 1 further comprising a control panel mounted to said base having selectors for controlling said driving means.

9. The kinetic rehabilitation device of claim 1 further comprising means for sensing movement of said connector without corresponding movement of either said first or second supports.

10. The kinetic rehabilitation device of claim 1 wherein said first and second supports have slots for receiving said first and second arms, respectively, said slots enabling relative movement therebetween, and said kinetic rehabilitation device further comprising means for sensing said relative movement.

11. The kinetic rehabilitation device of claim 10 wherein said sensing means comprises micro switches mounted to said first and second supports, respectively, and operatively engaging said first and second arms, respectively.

* * * * *